United States Patent [19]

Ruhlandt et al.

[11] Patent Number: 4,779,666

[45] Date of Patent: Oct. 25, 1988

[54] DIE CASTING PROCESS AND APPARATUS COMPRISING IN-DIE PLUNGER DENSIFICATION

[75] Inventors: Gerald K. Ruhlandt, Madison Heights; Timothy W. Skszek, Rochester, both of Mich.

[73] Assignee: General Motors Corporation, Detroit, Mich.

[21] Appl. No.: 391,106

[22] Filed: Jun. 23, 1982

[51] Int. Cl.[4] ..... B22D 27/11

[52] U.S. Cl. ..... 164/120; 164/320

[58] Field of Search ..... 164/120, 319–321

[56] References Cited

U.S. PATENT DOCUMENTS

| | | | |
|---|---|---|---|
| 2,181,157 | 11/1939 | Smith | 164/119 |
| 3,068,539 | 12/1962 | Wilcoxon | 164/320 |
| 3,106,002 | 10/1963 | Bauer | 164/320 |
| 3,120,038 | 2/1964 | Lauth | 164/320 |
| 3,664,410 | 5/1972 | Groteke | 164/303 |
| 4,380,261 | 4/1983 | Suzuki et al. | 164/120 |

FOREIGN PATENT DOCUMENTS

| | | |
|---|---|---|
| WO80/01655 | 8/1980 | PCT Int'l Appl. . |
| WO80/01656 | 8/1980 | PCT Int'l Appl. . |
| WO80/01657 | 8/1980 | PCT Int'l Appl. . |

*Primary Examiner*—Nicholas P. Godici
*Assistant Examiner*—Richard K. Seidel
*Attorney, Agent, or Firm*—Douglas D. Fekete

[57] ABSTRACT

A metal die casting apparatus preferably comprises a plunger core and a stationary core adapted to form recesses in the casting and to densify the metal to reduce shrink porosity. The cores are located at opposite sides of a die cavity and the plunger core is moveable in the direction of the stationary core to penetrate the metal while in a partially solidified, extrudable state. The cores are suitably shaped to displace metal laterally as the plunger core advances. The apparatus is particularly suited for forming a casting comprising an enlarged region intended to define a bore completely therethrough and surrounded by dense, nonporous metal.

6 Claims, 2 Drawing Sheets

DIE CASTING PROCESS AND APPARATUS COMPRISING IN-DIE PLUNGER DENSIFICATION

BACKGROUND OF THE INVENTION

This invention relates to a process for die casting metal that includes driving a plunger into metal within a die cavity during solidification to densify the metal. More particularly, this invention relates to utilizing plunger densification in die casting a metal article adapted to have a bore completely therethrough surrounded by dense, pore-free metal.

In die casting aluminum or similar metals, molten metal is injected into a die cavity and cooled to solidify it to form a product casting. Although molten metal initially fills the cavity, the volume of metal shrinks as it cools and solidifies, creating empty pores in the casting. Shrink pores are particularly formed in more massive, slower cooling sections where the metal solidifies last. One method for reducing shrink porosity employs a plunger to squeeze the metal within the die cavity to collapse the pores. The plunger is initially retracted in a channel that opens into the cavity and squeezes metal out from the channel using a substantially flat tip. This is principally effective for densifying the metal in the direction of the plunger, but has not been satisfactory for assuring densification in surrounding or more remote metal.

In casting articles such as transmission pump covers, the casting comprises an enlarged section that is subsequently drilled to form a bore extending completely through the casting. The use of cores during casting to form a portion of the bore is desired to reduce the machining required to finish the bore. It is also desired that the finished bore be surrounded by dense, nonporous metal along its entire length, which is complicated because shrink porosity is more severe in the enlarged section.

Therefore, it is an object of this invention to provide an improved method and apparatus for casting metal to form an article adapted to have a bore completely therethrough surrounded by densified metal substantially free of shrink porosity, which casting is carried out in a metal molding cavity comprising core members that form recesses in the casting that provide the basis for the completed bore and densify the metal intended to lie about the bore along its entire length.

More particularly, it is an object of this invention to provide coring within a metal molding cavity of a die casting apparatus and comprising opposed core members that are adapted to be driven together during casting while the metal is partially solidified and in an extrudable state to displace metal laterally to collapse shrink pores and thereby densify the metal. The cores form hollows in the casting that reduce the extent of machining required to complete a bore through the casting, which bore is surrounded by metal densified by the core members.

SUMMARY OF THE INVENTION

In a preferred embodiment, a die casting apparatus of this invention is adapted for molding a metal casting having an enlarged region intended to be bored completely through along a straight axis. The apparatus comprises die sections that cooperate to define a cavity suitably sized and shaped to substantially form the casting. A plunger core and a stationary core are incorporated into the die sections on opposite sides of the cavity along the axis. The plunger core is moveable along the axis between a retracted position for filing the bore region with metal during casting and an advanced position wherein the core extends into the cavity for forming an axial hollow in the casting. The plunger core is hydraulically driven into the advanced position with sufficient force to penetrate the metal while partially solidified. The tip is shaped so as to displace metal laterally as the core advances. The stationary core protrudes into the cavity and is also adapted for forming an axial hollow in the casting. The tip of the stationary core is suitably shaped to deflect metal displaced axially toward it such that the metal is deflected laterally and flows about the core. In the preferred embodiment, both tips are semispherical.

For casting, the plunger core is initially retracted and the cavity is filled with molten metal. As the metal cools and solidifies, it shrinks within the cavity, which creates pores in the metal, particularly within the slower cooling, enlarged bore region. After the metal has partially solidified, but while it is still in an extrudable state, the plunger core is driven into the metal along the axis in the direction of the stationary core. To accommodate the plunger advance, the semispherical tip displaces metal laterally. Metal displaced toward the stationary core is similarly deflected laterally by its tip. This metal displacement collapses shrink pores about the axis. Thereafter, the metal is further cooled to complete solidification, the core is retracted, the die sections are opened and the product casting is removed.

The product casting is suitably machined along the axis to form the desired bore. Because of the hollows formed by the cores, less metal must be machined away to complete the bore. In addition, displacement of the metal laterally by the tips of the cores during the plunger core advance densifies the metal about the axis so that the finished bore is surrounded by dense, void-free metal.

DETAILED DESCRIPTION OF THE INVENTION

Figure 1:
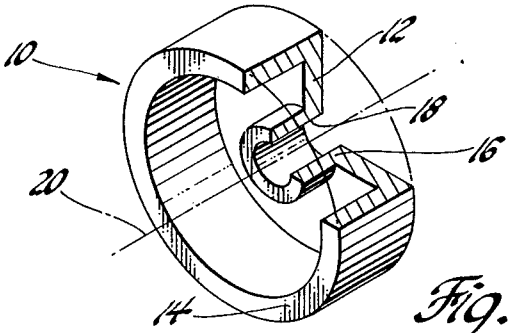
FIG. 1 is a perspective view of an article suitable for die casting in accordance with this invention.

For purposes of illustration, an embodiment of this invention is described for producing an article 10 shown in FIG. 1. Article 10 comprises a flat circular plate 12 and a peripheral wall 14. Article 10 also comprises a relatively massive hub section 16. Hub 16 defines a bore 18 completely therethrough and cylindrical about axis 20, which is perpendicular to plate 12. While this invention is directed to densifying the metal in hub section 16, densification is not necessarily limited to the hub section, but may advantageously extend to wall 14 under appropriate circumstances.

A preferred die casting apparatus 22 for forming a metal casting machinable to produce article 10 is illustrated in FIGS. 2 through 6. Apparatus 22 comprises a stationary platen 24 and a moveable platen 26. Stationary platen 24 carries a cover die block 28 wherein is mounted a watercooled die half section 30. Moveable platen 26 also carries a die block 32 wherein is mounted a second die half section 34. An ejector box 38 is located between moveable platen 26 and die block 32 and comprises a back plate 40 fixed to platen 26. Platen 26 is reciprocably moveable between a closed or forward position shown in FIG. 2 wherein die halves 30 and 34 mate and define a casting cavity 36 and an open or backward position shown in FIG. 6 for removing a product casting 42. Die blocks 28 and 32 and die halves 30 and 34 part along line 44. Cavity 36 is sized and shaped to substantially form article 10. A plurality of passages 45 are provided in die halves 30 and 34 for circulating water coolant to cool the die halves and thereby cool metal in cavity 36.

Metal 46 is injected into cavity 36 through a runner 48 that runs along parting line 44 and a restricted ingate 50 between the runner and the cavity. A shot assembly 52 is provided for injecting the metal and comprises a shot sleeve 54 that extends through platen 24 and die block 22 and communicates with runner 48. A shot plunger 56 is slidably mounted within sleeve 54 and connected to a two cycle hydraulic cylinder 58 through a connecting rod 60. Plunger 56 is adapted to reciprocate between a retracted position shown in FIG. 2 for ladling metal 46 into sleeve 54 through an opening 59 and an extended position shown in FIG. 4 wherein metal is forced into runner 48 and thus into cavity 36.

Ejector box 38 houses an ejector plate 62 that is adapted to slide parallel to the movement of platen 26. An ejector pin 64 fixed to plate 62 is slidably mounted through die block 32 and die half 34 and extends to cavity 36. Knockout bars 66 are slidably mounted through moveable platen 26 and ejector box back plate 40. Knockout bars 66 are stationary and are sized and positioned so that, ween platen 26 moves to open the die halves, bars 66 engage ejector plate 62 to extend ejector pin 64 through die half 34 and thereby urge the casting away from die half 34. Also fixed to plate 62 is a return pin 68 that is slidably mounted through die block 32 such that, when platen 26 moves to close the die halves, pin 68 engages die block 28 to slide plate 62 back into the position shown in FIG. 2.

Figure 2:
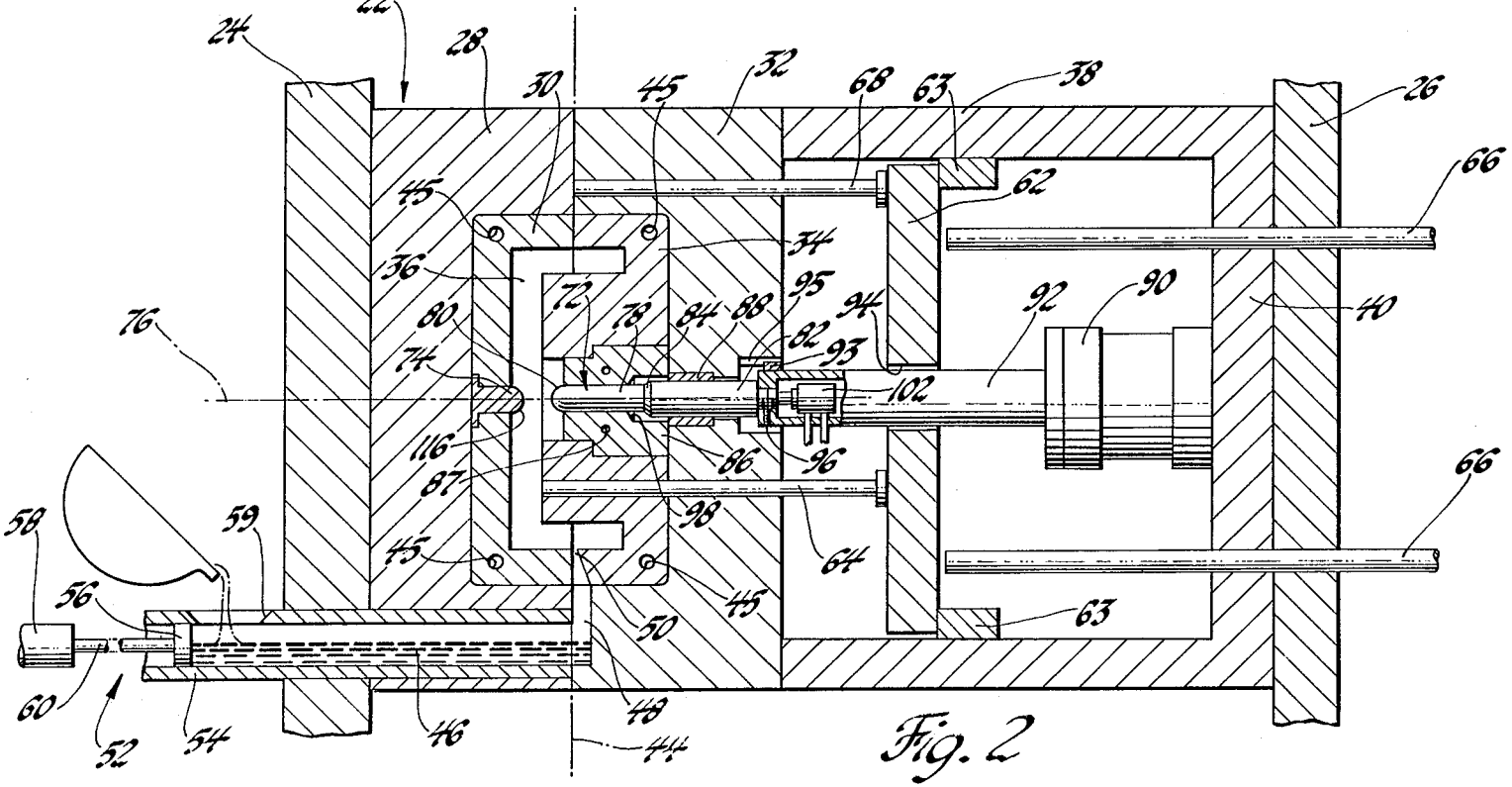
FIG. 2 is a cross sectional view of a die casting apparatus comprising a plunger core and a stationary core for densifying metal in accordance with this invention.
Figure 3:
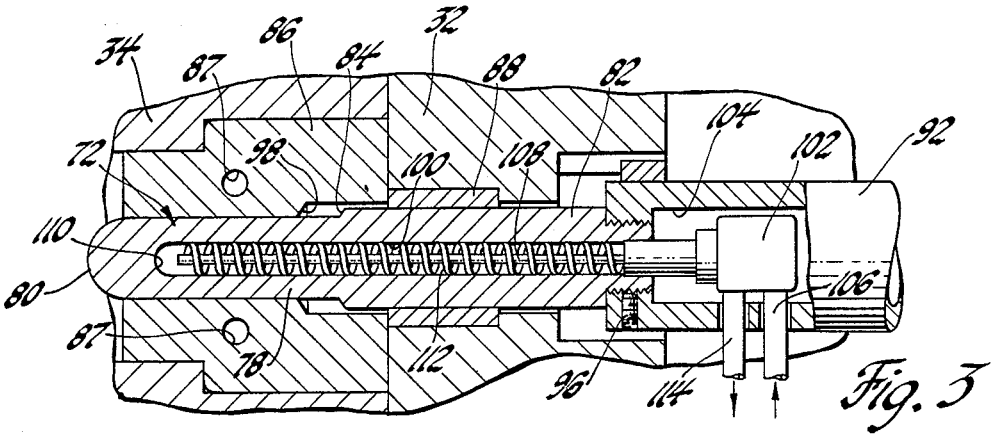
FIG. 3 is an enlarged, cross sectional view of the plunger core of FIG. 3 showing the details thereof.
Figure 6:
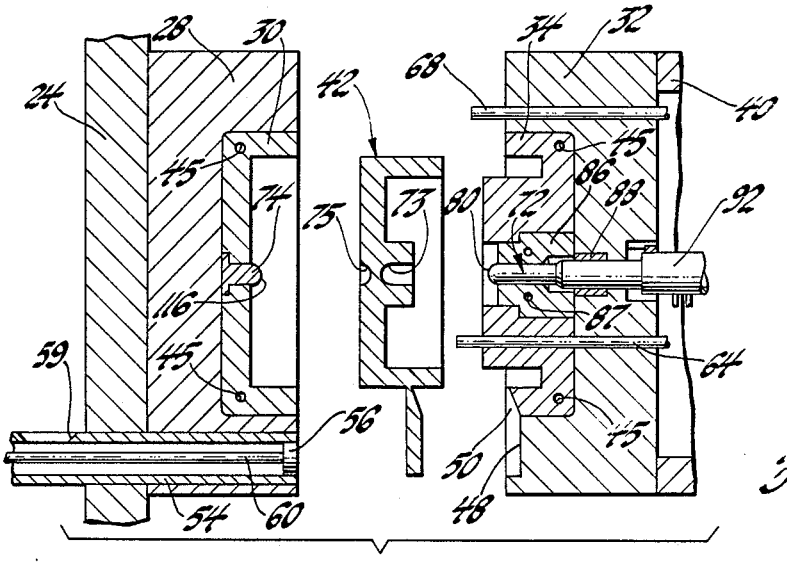
FIG. 6 is a partial view of the apparatus in FIG. 2, similar to FIGS. 4 and 5, and showing the position of the die elements after the metal has solidified and the die is opened for ejecting the product casting.

Die casting machine 22 also comprises a plunger core 72 and a stationary core 74 for densifying metal and forming recesses 73 and 75 in the casting 42, shown in FIG. 6 in accordance with this invention. Referring to FIGS. 2 and 3, plunger core 72 is generally cylindrical about an axis 76 that coincides with bore axis 20 as the casting is being formed in cavity 36. Core 72 comprises a metal penetration portion 78 having a semispherical tip 80 adjacent cavity 36, a relatively wider connecting portion 82 and a shoulder 84 therebetween. The penetration portion 78 is snugly but slidably fitted in a sleeve 86 secured in die half 34 and cooled by water circulating through passages 87. The connecting portion 82 extends through die block 32 and is slidably held in a guidance bushing 88. Core 72 is moveable along axis 76 between a retracted position shown in FIG. 2 for filling cavity 36 with metal and an advanced position shown in FIG. 5 for forming a recess in the casting. Core 72 is driven by a two cycle hydraulic cylinder 90 mounted onto the ejector box back plate 40 and is connected thereto by a connecting rod 92 that extends through an opening 94 in ejector plate 62. The connection portion 82 is threadably mounted into the end of connecting rod 92 and held by a set screw 96. Connecting rod 92 comprises a key 93 adapted to axially slide in a cooperating keyway 95 in die block 32 for guidance. The forward motion of core 72 is regulated by a mechanical stop 98 in sleeve 86 that is adapted to engage shoulder 84 of core 72.

Plunger core 72 is provided with a central axial passage 100 for circulating cooling water. Water is directed into passage 100 by a fountainhead 102 that is conveniently positioned in a chamber 104 in the connecting rod 92. Fountainhead 102 receives water through an inlet pipe 106 and directs the water down a central axial pipe 108 in passage 100 such that the water impinges upon an inner end passage surface 110 opposite the semispherical tip 80. The water returns to fountainhead 102 about pipe 108 guided by a helical vane 112. Fountainhead 102 accumulates the water for removal through an outlet pipe 114. The cooling of the plunger core 72 is described in further detail in U.S. patent application Ser. No. 391,104, incorporated herein by reference.

Stationary core 74 is located in cover die half 30 opposite moveable core 72 along axis 76 and is also adapted to form a recess 75 in the casting 42, shown in FIG. 6. Core 74 comprises a semispherical tip 116. Stop 98 in sleeve 86 is positioned to halt core 72 before hitting core 74.

Figure 4:
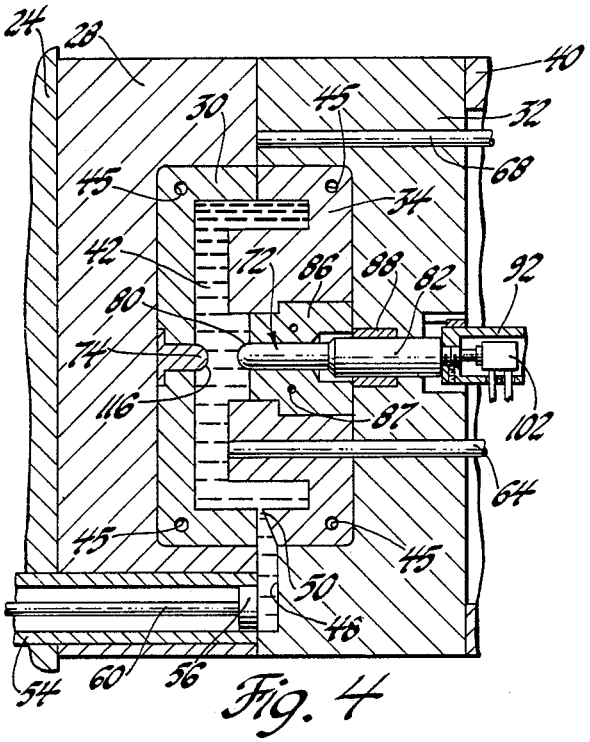
FIG. 4 is a partial view of the apparatus of FIG. 1 showing the position of the die elements including the plunger core after melt has been injected into the cavity.
Figure 5:
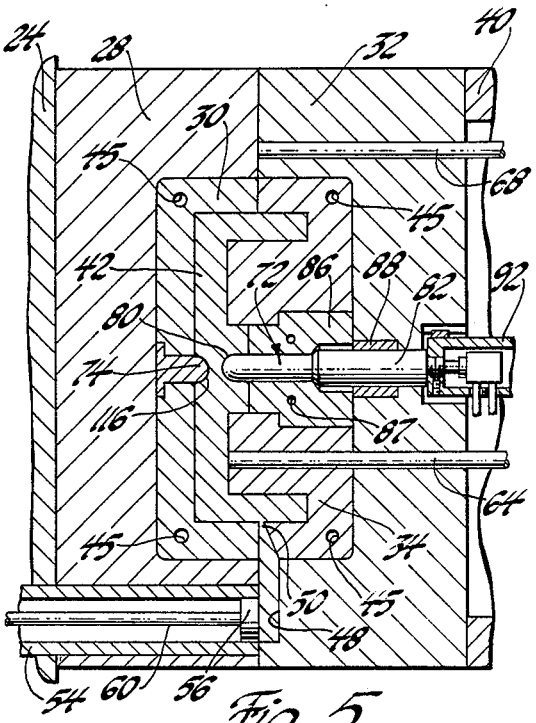
FIG. 5 is a partial view of the apparatus of FIG. 1, similar to FIG. 4, but showing the position of the plunger core after it is driven into the metal for densification.

The operation of die casting machine 22 will now be described. Initially platen 26 is moved into the position shown in FIG. 2 to close die halves 30 and 34 to form cavity 36, and plunger core 72 is retracted. With shot plunger 56 in the retracted position, the charge of molten metal 46 is poured into shot sleeve 54 through opening 58. Shot plunger 56 is then advanced, slowly at first until the metal charge 46 just fills the sleeve, and then fast to rapidly inject the metal through runner 48 and ingate 50 into cavity 36, filling the cavity, as shown in FIG. 4. The pressure applied by the shot plunger to the metal to fill the cavity is between about 6,000 to 9,000 psi. After filling, an intensification pressure between about 12,000 to 18,000 psi is applied by the shot plunger to reduce the size of trapped air bubbles and feed initial shrinkage.

In cavity 36, heat is extracted from the metal into water-cooled die halves 30 and 34, as well as into retracted water-cooled plunger core 72, causing the metal to begin solidification. The metal completely solidifies first at restricted ingate 50, blocking metal flow therethrough. After ingate solidification, the shot intensification pressure is no longer effective to feed shrinkage in cavity 36. Also, metal in cavity 36 cannot flow back into sprue 48, despite pressure applied by plunger core 72 in accordance with this invention.

Thermal contraction and the liquid-to-solid phase change reduces the metal volume so that it no longer fills cavity 36, whereupon pores form in the metal. Shrink pores are particularly a problem in an enlarged section 118 of casting 42 (FIG. 6) corresponding to article hub section 16, which cools slower because of its relatively large mass. After shrinkage has proceeded to where the cumulative pore volume is sufficient to accommodate the volume of displaced metal, but while the metal is still in a partially solidified and extrudable state, hydraulic cylinder 90 is actuated to drive plunger core 72 into the recess-forming position shown in FIG. 5. The pressure applied by core 72 to penetrate the metal is preferably between about 20,000 to 30,000 psi. If core 72 is actuated too early before sufficient shrinkage and while the metal is predominantly liquid, die halves 30 and 34 may be forced apart and the casting ruined. On the other hand, core 72 is driven into the metal before it has completely solidified, since solid metal requires substantially greater deformation pressure, typical of forging operations. Between these extremes, it is preferred to time the the core advanced to optimize densification in casting section 118. The pressure applied by core 72 is hydraulically distributed by the liquid phase of the partially solidified metal. Core 72 is preferably actuated when sufficient metal has solidified so that the liquid phase is not continuous throughout the casting, but while the metal in slower cooling hub section 118 contains sufficient liquid to facilitate densification. This allows the densification pressure to be concentrated within section 118. As core 72 plows through the metal, core tip 80, because of its semispherical shape, displaces metal radially. Similarly, stationary core tip 116, because of its semispherical shape, radially diverts metal pushed toward it by core 72. This radial displacement preferentially collapses shrink pores near axis 76 to assure solid metal about the intended bore.

In addition to assuring dense metal about the intended bore, semispherical tip 80 of plunger core 72 reduces the pressure required to penetrate the metal. Molten metal initially solidifies near the walls of cavity 36. Thus, a solid metal skin forms over plunger core tip 80. When the plunger core 72 is actuated, the semispherical shape aids to break through and shed the solid metal skin, so that the tip does not drag solid metal through the partially solidified metal. Thus, the pressure required to drive core 72 is reduced and core tip 80 is freed to direct the metal in the desired directions.

After core 72 is driven into the metal, cooling continues until the metal has completely solidified. Hydraulic cylinder 90 is then reversed to retract core 72. Platen 26 is moved away from platen 24 to part die halves 30 and 34, as shown in FIG. 6. As platen 26 moves away, knockout bar 68 engages ejector plate 62 to cause ejector pin 64 to push casting 42 away from die half 34 for removal. Thereafter, platen 26 is cycled forward to close the die halves to produce another casting, whereupon return pin 68 engages die block 28 and causes ejector plate 62 to slide into the position shown in FIG. 2 for casting.

As seen in FIG. 6, the product casting comprises two axial recesses 73 and 75 formed by cores 72 and 74, respectively, in the enlarged section 118. Casting 42 is readily drilled to complete bore 18 and remove excess runner metal 120 to form article 10. Because of recesses 73 and 75, the amount of metal that is machined away to complete bore 18 is greatly reduced. In addition, as a result of the metal densification produced by cores 72 and 74 in accordance with this invention, the metal about bore 18 is dense and substantially free of shrink porosity.

In the described embodiment, the plunger core is centrally cooled with circulating water. Cooling is not necessary for densification, but is preferred to inhibit soldering of the metal onto the core. Also, cooling reduces differential thermal expansion between the core and the surrounding sleeve to maintain a snug but sliding fit. Thus, water cooling permits larger diameter cores and deeper penetration, and reduces maintenance.

While in the preferred embodiment the cores have semispherical tips, it is apparent that other shapes are suitable for plowing through the metal and laterally displacing it. For example, a tip may have a conical shape. Also, the tip need not be symmetrical about the axis, but may be suitably shaped to preferentially displace metal in a particular lateral direction. Also, although in the described embodiment a moveable core is employed with a stationary core, it is apparent that both cores may move in the direction of the opposite core to densify the metal.

While this invention has been disclosed principally in terms of a particular embodiment, it is not intended to be limited to that embodiment, but rather only to the extent set forth in the following claims.

The embodiments of the invention in which an exclusive property or privilege is claimed are defined as follows:

1. A metal casting apparatus for forming a metal casting adapted to have a bore completely therethrough, said apparatus being adapted to densify the metal during casting that is intended to lie about the bore and comprising metal molding means for defining a cavity adapted to receive and mold molten metal and for cooling the metal within the cavity to solidify the metal to form the casting, whereupon voids form in the metal as a result of shrinkage during cooling, said means comprising opposed core members adapted to protrude into the metal within the cavity along an axis for forming coaxial recesses in the casting that form the basis of a bore through the casting, said core members being relatively axially moveable closer together and having facing surfaces suitably shaped to displace metal laterally to accommodate said relative core member movement, and means for driving said core members closer together along the axis during casting while said cavity contains partially solidified metal, whereby said facing core member surfaces displace the metal laterally to collapse voids about the axis to densify the metal intended to surround the bore.

2. A metal casting apparatus for forming a metal casting adapted to have a bore completely therethrough, which bore is surrounded by dense, nonporous metal, said apparatus comprising a die body adapted to define a fixed-volume cavity suitably sized and shaped for molding molten metal for substantially forming the casting and further adapted to receive molten metal into the cavity and to cool and solidify the metal within the cavity, whereupon voids form in the metal as a result of shrinkage during cooling, and coring means for forming the basis of the bore in the casting and for densifying the metal during casting that is intended to lie about the bore, said means comprising a moveable core member slidably mounted in the die body and adapted to extend into the cavity along an axis for forming a portion of the bore, said core member being axially moveable between a retracted position for filling the cavity with molten metal and an advanced position for extending into the metal for forming said bore portion, said core member comprising a tip within the cavity adapted to penetrate partially solidified metal as the core member axially moves toward the advanced position and suitably shaped to displace metal laterally in response to said core member advance, a stationary core member extending from the die body into the cavity opposite the moveable core member along the axis, said stationary core member being adapted to form a portion of the bore and being suitably shaped to laterally deflect metal axially flowing toward the stationary core member, and means for axially driving the moveable core member from the retracted position in the direction of the stationary core member to penetrate metal while the metal is partially cooled and in an extrudable state, said moveable core member tip and said stationary core member cooperating to displace metal radially about the axis to accommodate the core member penetration, said radial displacement collapsing voids about the axis to densify the metal intended to lie about the bore.

3. A die casting apparatus for forming a metal casting having an enlarged section adapted to be subsequently machined to define a bore extending completely through the casting about an axis, said apparatus being adapted to densify metal in the enlarged section such that the finished bore is surrounded by dense, void-free metal and comprising two cooled die sections adapted to define a fixed-volume metal molding cavity, which cavity is adapted to receive molten metal and is suitably sized and shaped for molding the molten metal to form the casting, said sections being relatively moveable between a closed position wherein the sections define the cavity and an open position for removing the casting, said sections being suitably cooled to solidify molten metal within the cavity, whereupon shrinkage of the metal produces pores in the enlarged section, means for injecting molten metal into the cavity through an ingate sized and located such that metal solidifies to seal the ingate while metal within the enlarged section is partially solidified and in an extrudable state, a plunger core member slidably mounted in said die section and adapted to extend into the cavity along an axis corresponding to the bore axis in the casting to form a recess in the casting, said plunger core member being axially moveable between a retracted position for injecting metal into the cavity including the bore region and an advanced position wherein the plunger core member extends into the metal to form the recess, said plunger core member having a semispherical lead tip adapted to axially penetrate and laterally displace extrudable metal, a deflector core member coaxially protruding above a said die section into the cavity opposite the plunger core member and adapted to form a coaxial recess in the casting opposite the plunger core member recess, said deflector core member having a semispherical tip facing the plunger core member lead tip and adapted to laterally displace extrudable metal axially impinging thereupon, and means for axially driving the plunger core member toward the deflector core member to penetrate extrudable metal within the cavity, whereupon said semispherical core tips displace metal radially to accommodate the plunger core member advance and to collapse shrink pores in the metal about the intended bore, and whereupon said bore is partially formed in the casting by the coaxial recesses formed by the core members.

4. A method for forming a metal casting comprising a region adapted to have a bore completely therethrough, which bore is surrounded by dense, nonporous metal, said method comprising filling a fixed volume cavity with molten metal, said cavity being sized and shaped to mold the metal to form the casting, cooling the molten metal within the cavity through an extrudable state to a solidified state over a period of time, whereupon shrinkage of the metal forms voids in the metal, driving a first core member into the metal along an axis in the direction of a second core member located opposite said first core member within the cavity while the metal therein is in the extrudable state, said members thereafter extending into the metal to form coaxial recesses in opposite sides of the casting, which recesses form the basis of the bore, said core members comprising facing tip surfaces that laterally displace the metal about the axis to accomodate the core member movement and to collapse voids within the metal, thereby densifying the metal intended to surround the bore.

5. A method for forming a metal casting adapted to have a bore subsequently formed completely therethrough and surrounded by dense, nonporous metal, said method comprising injecting molten metal into a fixed-volume metal molding cavity suitably sized and shaped to substantially form the casting except for the bore, forming a first recess in the metal using a fixed core member extending into the cavity along an axis, said recess being adapted for forming a portion of the bore, said core member having a tip suitably shaped to laterally deflect metal axially flowing toward said member, cooling the metal within the cavity to partially solidify metal in the bore region, whereupon shrinkage produces voids in the metal, driving a core member into the cavity along the axis in the direction of the fixed core member to penetrate the metal while in a partially solidified and extrudable state and to form an opposite coaxial recess in the metal, said recess being adapted to form a portion of the bore, said driven core member having a lead tip suitably shaped to predominantly displace metal laterally to accommodate the core member penetration, said driven core member also driving a portion of the metal toward the fixed core member which metal is laterally displaced, said lateral metal displacement collapsing voids about the axis and thereby densifying the metal intended to lie about the bore, and cooling the metal to complete solidification to form the casting, wherein said recesses form the basis of the bore through the casting.

6. A method for forming a cast metal article having a bore completely therethrough about an axis, which bore is defined by dense, nonporous metal, said method comprising injecting molten metal into a fixed-volume volume cavity defined within a die casting body, said cavity being sized and shaped for casting the metal to substantially form the article except for the bore, said die body comprising an axially moveable core member and a stationary core member adapted to extend into the cavity from opposite sides along the axis for forming coaxial recesses in the casting that form the basis of the bore in the article, said moveable core member and said stationary core member having facing semispherical tips, cooling the metal within the cavity to partially solidify metal in the bore region, whereupon shrinkage produces pores in the metal, driving the moveable core member into the cavity along the axis in the direction of the stationary core member to penetrate the metal while in a partially solidified, but extrudable state, the semispherical core member tips cooperating to displace metal radially about the axis to accommodate the core member penetration, the displaced metal collapsing pores and thereby densifying the metal intended to define the bore, further cooling the metal to complete solidification to form the casting, removing the casting from the die body, and machining the casting along the axis between the recesses to complete the bore and thereby form the article.

* * * * *